United States Patent [19]

Lorenzen et al.

[11] 4,065,823

[45] Jan. 3, 1978

[54] HYDROSTATICALLY ACTIVATED RELEASE MECHANISM

[76] Inventors: James Walter Lorenzen, 6956 Colonial Drive; Bruce John Schaefer, 2707 Russell Road, both of Tecumseh, Mich. 49286

[21] Appl. No.: 741,342

[22] Filed: Nov. 12, 1976

[51] Int. Cl.[2] ..... B63B 21/52; B63C 9/28

[52] U.S. Cl. ..... 9/9; 9/14; 116/124 B

[58] Field of Search ..... 9/9, 7, 14, 312, 325, 9/400, 12, 13; 5/345 R; 116/124 B; 244/122 R; 114/44, 68, 190

[56] References Cited

U.S. PATENT DOCUMENTS

| | | | |
|---|---|---|---|
| 2,569,977 | 10/1951 | Dickinson | 9/9 |
| 3,156,933 | 11/1964 | Brooks | 9/9 |

*Primary Examiner*—Barry L. Kelmachter

[57] ABSTRACT

This invention relates to a hydrostatically activated release mechanism for vehicles which are subject to accidental submersion in water. The release mechanism contains an activating device, a latching mechanism which is connected to buoyant seat cushions and a mechanism for transmitting movement from the activating device to the latching mechanism. The activating device, which is pressure operated, releases the buoyant seat cushion when the vehicle is submerged in water, thereby providing an emergency floating gear for the passengers of said vehicle.

7 Claims, 3 Drawing Figures

HYDROSTATICALLY ACTIVATED RELEASE MECHANISM

BACKGROUND

The present invention relates to a release mechanism and more particularly to a hydrostatic release mechanism containing an activating device and a means for connecting the activating device to buoyant seat cushions. The release mechanism is especially adapted for vehicles such as snowmobiles, sleds or similar vehicles which travel over water. In the event the vehicle becomes submerged in water, the release mechanism releases buoyant seat cushions which will serve as floatation gear for the passenger of the vehicle.

With the use of snowmobiles and attached sleds becoming popular, their use on frozen lakes and rivers is very common. This has resulted in an increasing number of accidents where vehicles encounter thin ice and break through with the result that both vehicles and passengers are cast into freezing water. Since occupants of these vehicles are normally dressing in heavy clothing, their ability to swim to safety is greatly restricted and often impossible. Moreover, the water current has a tendency to move submerged people away from the opening in the ice, thus making rescue almost impossible. Due to this and other adverse conditions, fatalities are often associated with this type of accident.

SUMMARY

This invention relates to a release mechanism which readily releases floatation cushions when the vehicle is submerged in water. This is accomplished by replacing the existing seat of the vehicle with one constructed of a buoyant material which is readily released in the event the vehicle is submerged in dangerous waters.

It is essential for proper operation that the seat cushions be securely fastened to the vehicle. To provide a method of securely holding the floating seat cushion in place during normal operation, yet releasing it quickly in the event the vehicle is submerged into water, the invention utilizes a release mechanism containing an hydrostatically operated activating device and a means for connecting the activating device to the floatation seat cushions. The activating device utilizes a pressure diffential between the ambient air and water on the submerged vehicle to create a force which through suitable linkage will release the floatation seat cushions. Moreover, the activating device preferably operates with a minimum of water pressure; however, it will not be affected by changes in barometric pressure. Thus, the operation of the activating device is primarily a function of the depth of surrounding water.

It is thus an object of this invention to provide floatation seat cushions for victims cast into freezing water from vehicles. Another object of this invention is to provide a mechanism for releasing the cushions when the vehicle is submerged in water. A further object of this invention is to provide a device which is activated by a pressure differential between the atmosphere and the water.

DESCRIPTION

Figure 1:
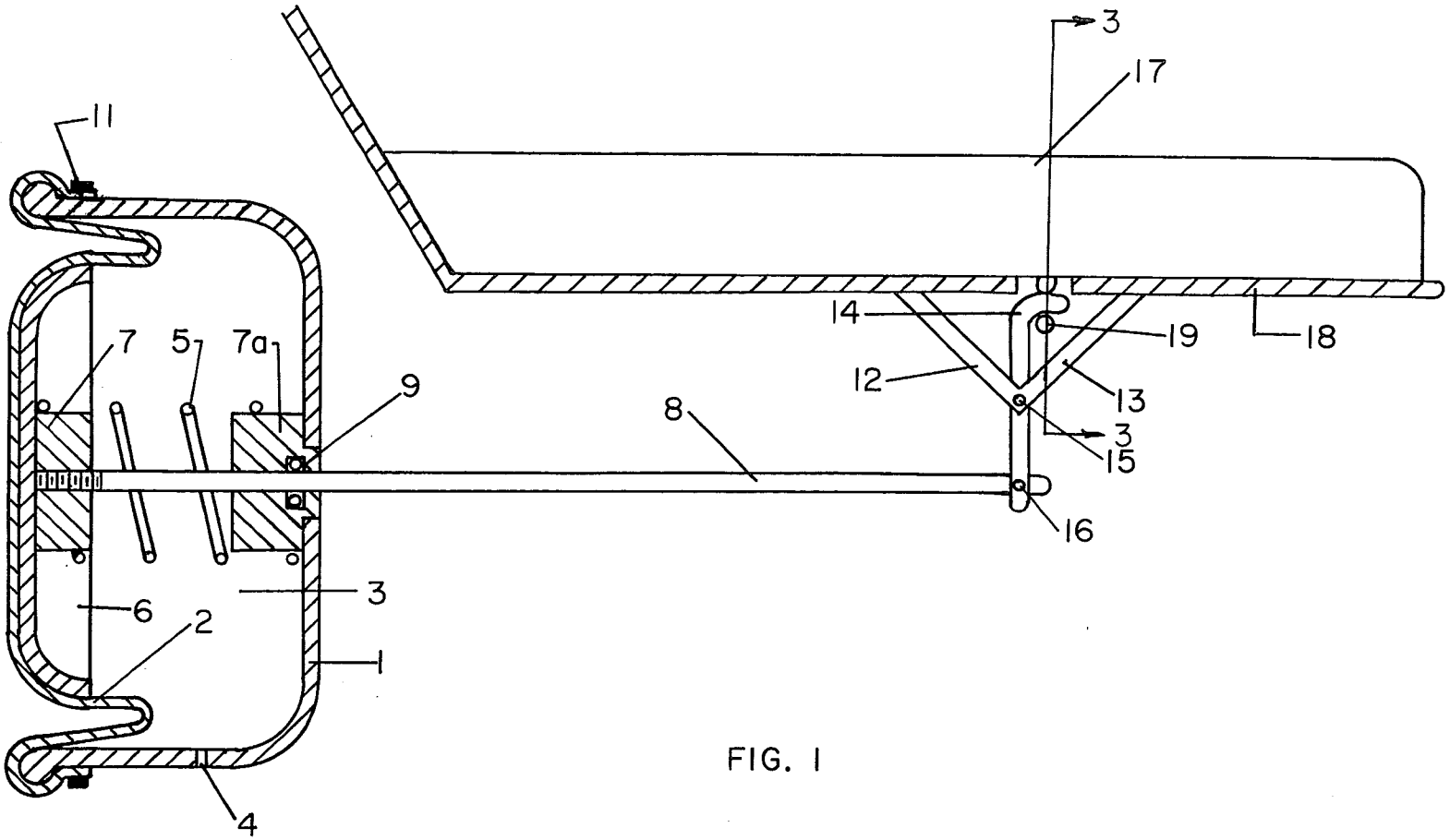
FIG. 1 shows a sectional view of the release mechanism containing a pressure activated device and the linkage for connecting the pressure activated device to the floatation cushion.
Figure 2:
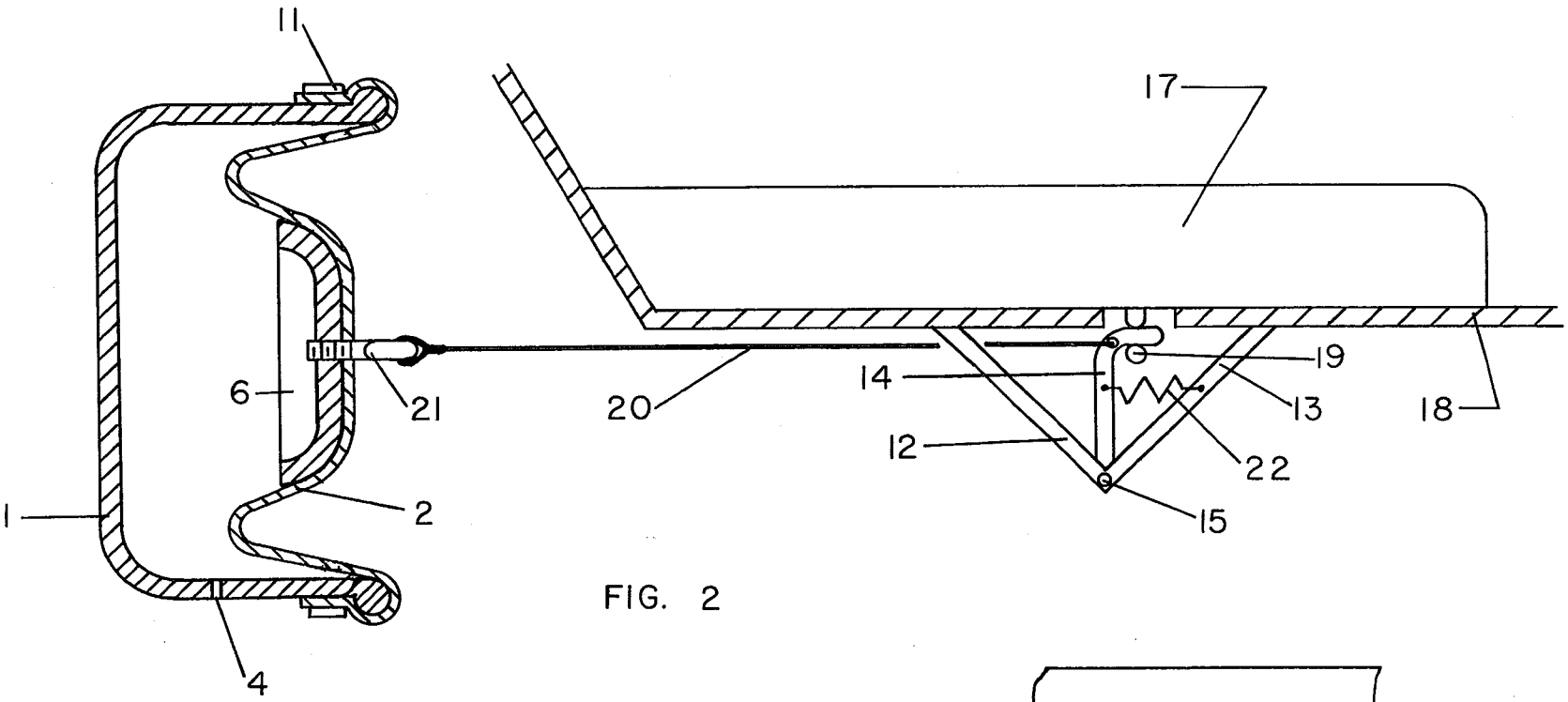
FIG. 2 shows a sectional view of an alternate release mechanism containing a pressure activated device and a means for connecting the pressure activated device to a floatation cushion.

Referring now to the drawings, FIGS. 1 and 2 illustrate a mechanism for releasing flotation cushions in the event that the vehicle is submerged in water. FIG. 1 shows a release mechanism comprising a pressure activated device containing a chamber formed by a hollow body 1 and a flexible diaphragm 2. The diaphragm may be made of any material capable of movement in response to hydrostatic pressure, elastomeric materials, such as natural or synthetic rubber, silicons, urethanes and the like. The chamber 3 is vented to the atmosphere through a small vent hole 4 to compensate for changes in the altitude or barometric pressure. If the chamber 3 was hermetically sealed or unvented, it would increase the depth to which the vehicle would have to be submerged before the activating device would operate, especially on days of lower barometric pressure or at higher altitudes. It is also essential that the vent hole 4 be small in order to restrict the flow of water into the chamber and thus provide sufficient time to activate the activating device and in turn release the floatation seat cushions. As the water pressure increases around the pressure activating device, its force will be transmitted through the diaphragm 2 to the follower plate 6 which is shown as a saucer shaped disk having a symmetrically located threaded boss 7. The boss 7 may be an integral part of follower plate 6 or a machined piece securely fastened to the follower plate 6 by for example, welding or by some other means. The boss 7 serve two functions, one to act as the connecting point for the activating shaft 8 and the second as a guide for spring 5.

The spring 5 exerts sufficient force against the metal housing 1 and the follower plate 6 to keep the release linkage in place during the normal operation of the vehicle. It is preferred that the spring be relatively long with respect to the travel of the diaphragm 2 and follower 6, thereby providing a nearly constant holding force during the operation of the mechanism. The pressure activating device is connected to the cushion through shaft 8 which transmits the force exerted by the water pressure to a cushion latching mechanism consisting of support means 12 and 13, holddown lever(s) 14, and latching means 19. The activating shaft 8 passes through and is supported intermediate at its ends by guide *7a* which is constructed of a self lubricating material such as nylon or teflon. The "0" ring 9 is optional, since it is possible to have the clearance between the shaft 8 and the guide *7a* sufficiently close to prevent water flow into chamber 3 or to use other common sealing devices. The diaphragm 2 is secured to the housing 1 by any conventional means known in the art such as by clamps 11.

The hollow body 1, which may be made from metal or rigid plastics, may be connected to the seat supporting deck 18 by any conventional means known in the art. The floatation cushion 17 rests upon the supporting deck 18 and is secured by a latching means 19, such as a pin(s) or eye bolt(s) which are an integral part of the floatation cushion. The holddown lever(s) 14 interlock with latching means 19 and securely hold the cushion in place. As the water pressure increases, diaphragm 2, moves inwardly towards the opposite inside surface of hollow body 1, causing shaft 8 to move in a forward direction. As shaft 8 moves in a forward direction lever(s) 14 is rotated in a counter clockwise direction around fulcrums 15 and 16, thereby releasing locking means 19 and cushion 17.

FIG. 2 shows a sectional view of a release mechanism in which tensile force is employed to release the floatation cushion. Again the mechanism consists of an activating device containing a hollow body 1 which is connected to the supportive deck 18 of the vehicle and a diaphragm 2. As in FIG. 1, the chamber 3 is vented to the atmosphere through a small vent hole 4 to compensate for changes in altitude or barometric pressure. When the vehicle becomes submerged in water, the water pressure causes the diaphragm 2 and follower plate 6 to move in an inward direction with respect to the hollow body 1. Movement of the diaphragm and follower plate exerts tension on cable 20 which is connected on its one end to eye bolt 21 and on its opposite end to lever(s) 14, thereby rotating lever(s) 14 in a counter clockwise direction around fulcrum 15 to release latching means 19 and cushion 17. Spring 22 is connected to support means 13 on its one end and to lever(s) 14 on its opposite end in order to keep lever(s) 14 locked in place for normal operation. Since an external spring is required for this arrangement, the internal spring 5 and related parts shown in FIG. 1 in the activating device may be omitted.

Figure 3:
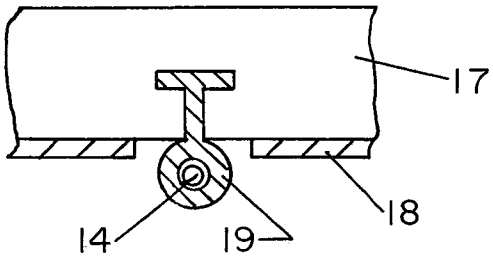
FIG. 3 shows a cross sectional view of the latching mechanism taken along line 3—3 of FIG. 1.

FIG. 3 shows a cross sectional view of a latching means in which an eye bolt(s) is used as latching means 19 for securing the flotation cushion 17 to support deck 18.

OPERATION

With reference to FIG. 1, when the vehicle is submerged in water, the release mechanism is activated by an increase in hydrostatic pressure on the exterior surface of diaphragm 2. The increase in pressure causes the diaphragm 2 and follower plate 6, which is in contact with diaphragm 2 and connected to shaft 8, through boss 7, to move inward towards hollow body 1. Movement of the diaphragm in an inward direction causes shaft 8, which is connected to boss 7 on its one end and on its opposite end to lever(s) 14 at point 16, to move in a forward direction; thereby rotating lever(s) 14 in a counter clockwise direction and thus disengaging latching means 19. The cushion thus released from the vehicle serves as a floatation gear for the passengers.

With reference to FIG. 2, as the hydrostatic pressure on the exterior surface of diaphragm 2 increases, the diaphragm 2 and follower plate 6, move inwardly toward the opposite inside surface of hollow body 1 thereby exerting tension on cable 20, which in turn rotate lever(s) 14 in a counter clockwise direction, thus disengaging latching means 19 and thereby releasing the floatation cushion from the submerged vehicle.

Although certain specific embodiments of the invention have been shown and described, it is obvious that many modifications thereof are possible.

What is claimed is:

1. A hydrostatically operated mechanism for releasing a floatation seat cushion comprising an activating device consisting of a hollow body, a flexible wall capable of movement in response to a pressure differential which is secured across said hollow body to form a single chamber which is vented to the atmosphere, and a means for transmitting movement of the flexible wall to a means which releases the floatation cushion.

2. The mechanism of claim 1 wherein the flexible wall is an elastomeric diaphragm.

3. The mechanism of claim 1 wherein the means for transmitting movement of the flexible wall of said activating device to said cushion release means is a shaft.

4. The mechanism of claim 1 wherein the means for transmitting movement of the flexible wall of said activating device to said cushion release means is a cable.

5. The mechanism of claim 1 wherein the means for releasing the cushion consists of a lever which slideway engages a latching means connected to the lower portion of the floatation cushion.

6. The mechanism of claim 5 wherein the latching means consists of an eye bolt which is connected to the floatation cushion.

7. The mechanism of claim 1 wherein the activating device contains a follower plate which is in contact with the internal surface of said flexible wall and is connected to said means for transmitting movement of the flexible wall.

* * * * *